US005611631A

United States Patent [19]

Ooishi et al.

[11] Patent Number: 5,611,631

[45] Date of Patent: Mar. 18, 1997

[54] IMPACT PRINTER WITH REDUCED ELECTROCORROSION USING ZENER DIODE FOR STATIC DISCHARGE

[75] Inventors: Noboru Ooishi; Hirokazu Andou; Toshiro Suemune; Mitsuru Kishimoto, all of Tokyo, Japan

[73] Assignee: Oki Electric Industry Co., Ltd., Tokyo, Japan

[21] Appl. No.: 413,751

[22] Filed: Mar. 30, 1995

[30] Foreign Application Priority Data

Apr. 15, 1994 [JP] Japan ..... 6-102017

[51] Int. Cl.[6] ..... B41J 2/235

[52] U.S. Cl. ..... 400/124.11; 400/124.17

[58] Field of Search ..... 400/124.11, 124.17, 400/124.23; 361/56, 58, 91, 212, 214, 220

[56] References Cited

U.S. PATENT DOCUMENTS

| | | | |
|---|---|---|---|
| 4,638,397 | 1/1987 | Foley | 361/212 |
| 4,791,524 | 12/1988 | Teigen et al. | 361/212 |
| 4,868,907 | 9/1989 | Folkins | 361/212 |
| 5,179,497 | 1/1993 | Bakhoum | 361/220 |

FOREIGN PATENT DOCUMENTS

| | | | |
|---|---|---|---|
| 0422839 | 4/1991 | European Pat. Off. | 400/124.11 |
| 62-68766 | 3/1987 | Japan | 400/124.11 |
| 3-108564 | 5/1991 | Japan | 400/120.01 |

*Primary Examiner*—John S. Hilten
*Assistant Examiner*—Steven S. Kelley
*Attorney, Agent, or Firm*—Panitch Schwarze Jacobs & Nadel, P.C.

[57] ABSTRACT

An impact printer has a print head in which demagnetizing coils are embedded in a filling compound. A resistor or Zener diode is connected in series between the print head and the printer's frame ground, to prevent current flow through the filling compound from causing corrosion of the demagnetizing coils, while permitting discharge of static charge from the print head to ground.

3 Claims, 4 Drawing Sheets

IMPACT PRINTER WITH REDUCED ELECTROCORROSION USING ZENER DIODE FOR STATIC DISCHARGE

BACKGROUND OF THE INVENTION

The present invention relates to an impact printer with a print head grounded in such as way as to reduce electrocorrosion.

The print head of an impact printer has a plurality of electromagnets embedded in a filling compound that provides electrical insulation and serves as a heat sink. To prevent build-up of static charges generated during paper transport, the print head is electrically grounded to the printer's chassis, that is, to the printer's frame ground.

Epoxy resin compounds are often used as the filler in the print head, but at temperatures above 150° C., which are not unknown in high-speed impact printing, these compounds begin to dissociate, liberating chemically reactive negative ions. In addition, the insulation resistance of the compound is reduced and current begins to leak from the positive poles of the electromagnets to the frame ground. As part of this current, the negative ions migrate toward the positive poles of the electromagnets. At high temperatures these ions react readily with the insulation protecting the wiring of the electromagnet coils, and with the conductive metal of the wiring itself. Over time these reactions, referred to hereinafter as electrocorrosion, can produce short circuits or open circuits in the electromagnet coils, ending the useful service life of the print head.

Electrocorrosion increases with the operating temperature and operating voltage of the print head. In recent high-speed impact printers, electrocorrosion has become a serious problem.

To avoid electrocorrosion, some printer manufacturers have turned to silicon-based resin filling compounds. After curing, these compounds remain chemically stable even at temperatures of 180° C., so electrocorrosion is effectively prevented. Before curing, however, the theological properties of these compounds leave much to be desired. Particularly in high-pin-count print heads such as twenty-four-pin heads, the high viscosity of the silicon-based resin makes it difficult to fill the narrow spaces between the closely-packed electromagnets, so that the coils may be left partially exposed. The filling compound thus provides inadequate heat sinking, resulting in early burn-out of the exposed coils.

For densely-structured impact print heads, no alternative is readily at hand to epoxy resin filling compounds, electrocorrosion notwithstanding.

SUMMARY OF THE INVENTION

It is accordingly an object of the present invention to reduce electrocorrosion in the print head of an impact printer.

The invented impact printer has a resistor or Zener diode inserted in series between its print head and frame ground.

DETAILED DESCRIPTION OF THE INVENTION

Embodiments of the invention will be described with reference to the attached illustrative drawings.

Figure 1:
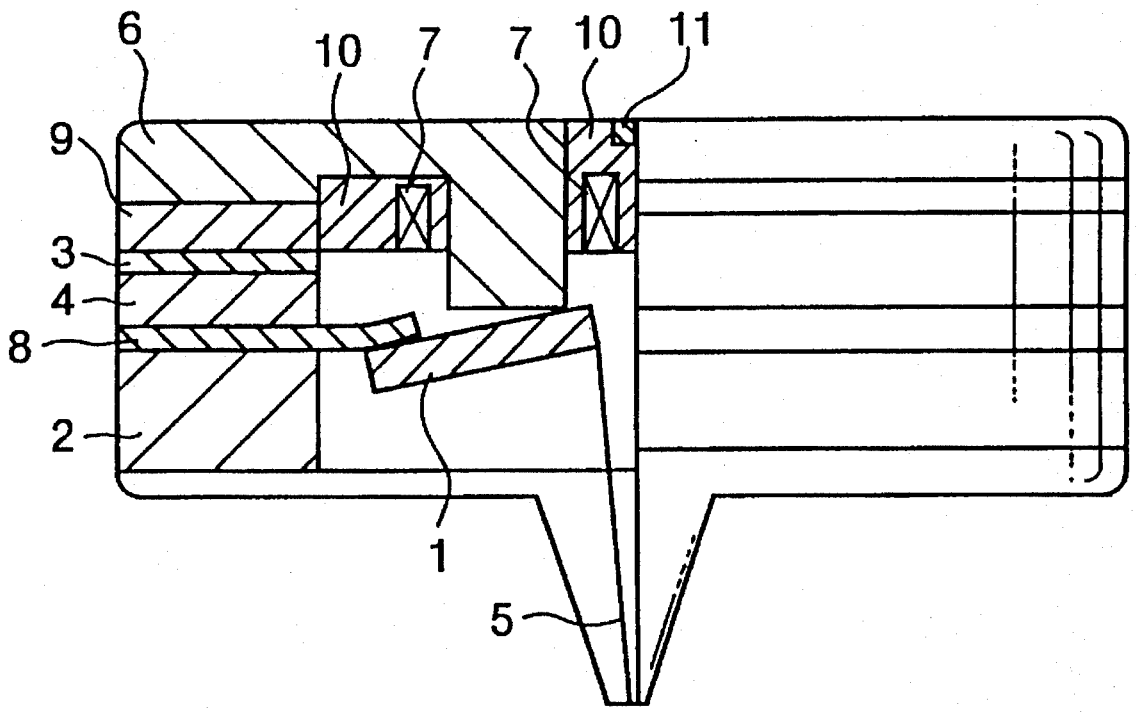
FIG. 1 is a partially cutaway diagram of the print head of an impact printer.

FIG. 1 is a partially cutaway view of the print head of a typical impact printer, showing the general setting in which the present invention can be practiced. The elements shown in FIG. 1 are an armature 1, first yoke 2, permanent magnet 3, second yoke 4, print pin 5, core 6, demagnetizing coil 7, plate spring 8, third yoke 9, filling compound 10, and thermistor 11. The print pin 5 is attached to one end of the armature 1, which is affixed to the plate spring 8. Although only one print pin 5 is shown, the print head comprises a plurality of print pins 5 and their associated armatures 1, demagnetizing coils 7, and other elements.

When the demagnetizing coil 7 is not energized, the magnetic flux generated by the permanent magnet 3 is guided in a magnetic circuit that includes the third yoke 9, core 6, armature 1, first yoke 2, and second yoke 4, creating an attractive magnetic force between the armature 1 and core 6. The armature 1 is thereby held in contact with the core 6, flexing the plate spring 8.

When the demagnetizing coil 7 is energized, the resulting magnetic flux cancels the magnetic flux of the permanent magnet 3, so that there is no net flow of flux between the armature 1 and core 6. The armature 1 is accordingly released, and the plate spring 8 drives it downward in the drawing, impelling the print pin 5 against an ink ribbon to print a dot on a sheet of paper, or other print media. (The ribbon and paper have been omitted from the drawing.)

During printing, the demagnetizing coil 7 is repeatedly energized and de-energized. As printing continues, current flow in the demagnetizing coil 7 and eddy currents generated in the core 6 produce heat that raises the temperature of the demagnetizing coil 7. This heat is carried away by the filling compound 10, and detected by the thermistor 11, which measures the temperature of the print head.

Figure 2:
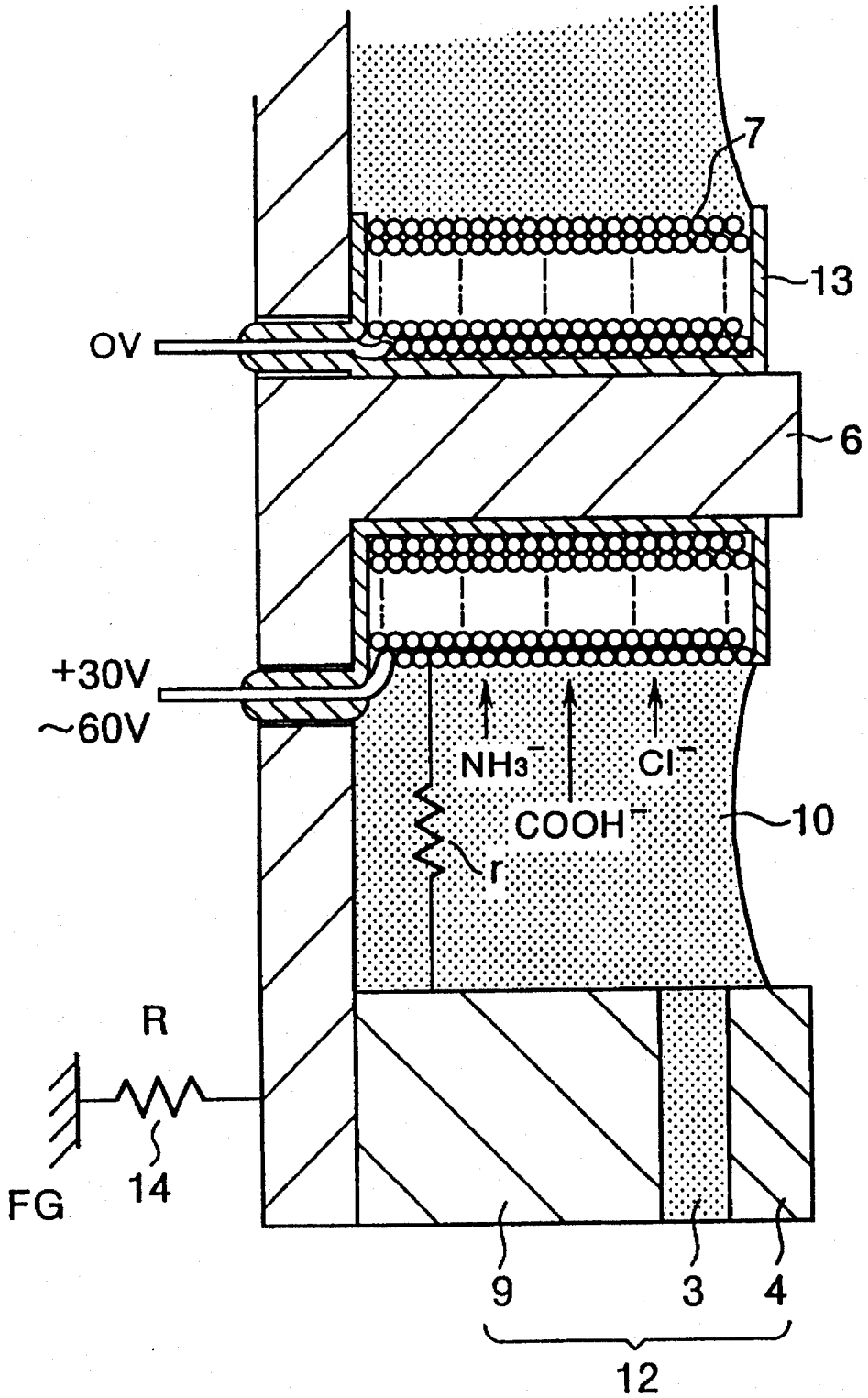
FIG. 2 is a more detailed sectional view of the print head, showing a first embodiment of the invention.

FIG. 2 is an enlarged view of the core 6 and its surrounding parts, illustrating a first embodiment of the invention. The demagnetizing coil 7 is held within a head frame 12 comprising the permanent magnet 3, second yoke 4, third yoke 9, and other parts that were shown in FIG. 1. The demagnetizing coil 7 is wound on a bobbin 13. The filling compound 10 both provides mechanical support for the demagnetizing coil 7 and acts as a heat sink, dissipating heat generated by the demagnetizing coil 7.

The novel element in the first embodiment is a resistor 14 coupled in series between the head frame 12 and the chassis of the printer. The chassis is not illustrated in the drawing, but is denoted by the symbol marked FG, for frame ground. In the drawing the resistor 14 is coupled to the core 6, but of course it may be coupled directly to the head frame 12 instead.

Next, the operation will be described.

To print dots, the demagnetizing coil 7 is driven at a voltage in the range of, for example, 30 V to 60 V. The resultant heating raises the temperature of the filling compound 10 to a value typically in the range from 100° C. to 130° C. (Voltage and temperature values will vary, depending on the printer model.) As discussed above, negative ions such as $NH_3^-$, $Cl^-$, and $COOH^-$ are liberated and migrate toward the positive pole of the demagnetizing coil 7, as current flows from that pole through the filling compound 10 to the head frame 12 and core 6, then through the resistor 14 to the frame ground.

The amount of electrocorrosion caused by these ions is proportional to the current flow, and therefore inversely proportional to the series resistance between the demagnetizing coil 7 and frame ground. Tests indicate that if this resistance is one megohm (1 MΩ), the life of the print head will be about ten million dots per pin, meaning that this number of dots can be printed before failure due to electrocorrosion. A print head is typically specified for a service life of two hundred million dots per pin. From this it can be calculated that the resistance between the demagnetizing coil 7 and frame ground must be at least twenty megohms (20 MΩ).

Figure 3:
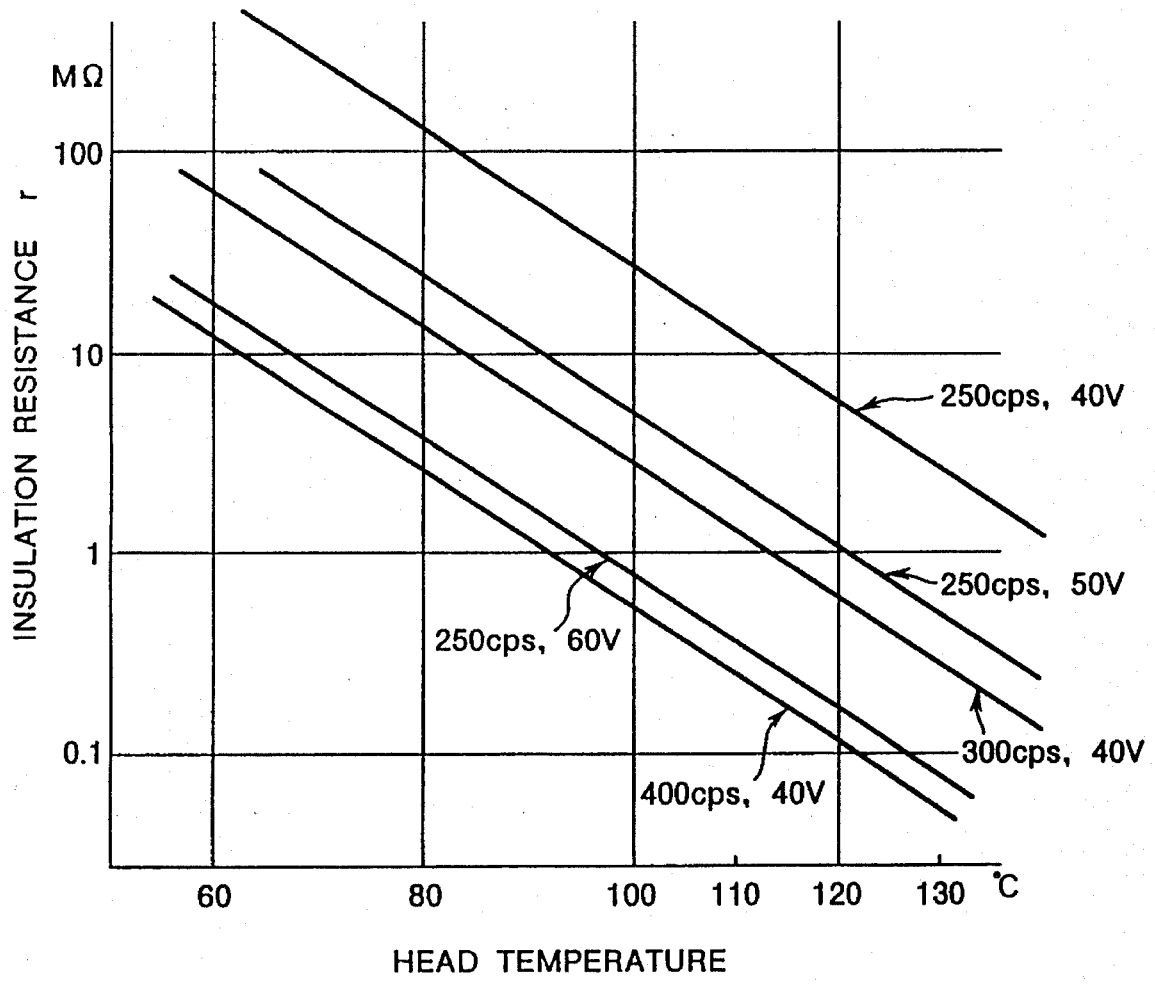
FIG. 3 illustrates temperature characteristics of the insulation resistance of the filling compound under various operating conditions.

Referring to FIG. 3, the insulation resistance r of the filling compound 10 depends on the temperature of the print head, with different dependency relations being obtained at different operating speeds and voltages. FIG. 3 shows typical examples of the dependency relation for printing speeds from 250 cps (characters per second) to 400 cps, and operating voltages from 40 V to 60 V. The insulation resistance r of the filling compound 10 is shown on the vertical axis in FIG. 3, and print-head temperature on the horizontal axis.

As can be seen from FIG. 3, in a high-speed printer the insulation resistance r of the filling compound 10 may decrease to about 0.1 MΩ, which falls far short of the necessary 20 MΩ. If the resistor 14 has a resistance R of substantially 20 MΩ, however, the sum of R and r will provide the necessary series resistance between the demagnetizing coil 7 and frame ground. At high temperatures, most of the potential drop between the demagnetizing coil 7 and frame ground FG will occur across the resistor 14, so the potential difference between the demagnetizing coil 7 and head frame 12 will be greatly reduced, with a corresponding reduction in the migration of reactive negative ions toward the demagnetizing coil 7.

If the resistance R of the resistor 14 is too high, build-up of static charge oil the print head will become a problem, but a value of R on the order of several megohms, or several tens of megohms, will alleviate electrocorrosion and still provide adequate discharging capability to prevent electrostatic discharge damage. Appropriate values of R for specific printer models can be determined from temperature characteristics such as those in FIG. 3.

Figure 4:
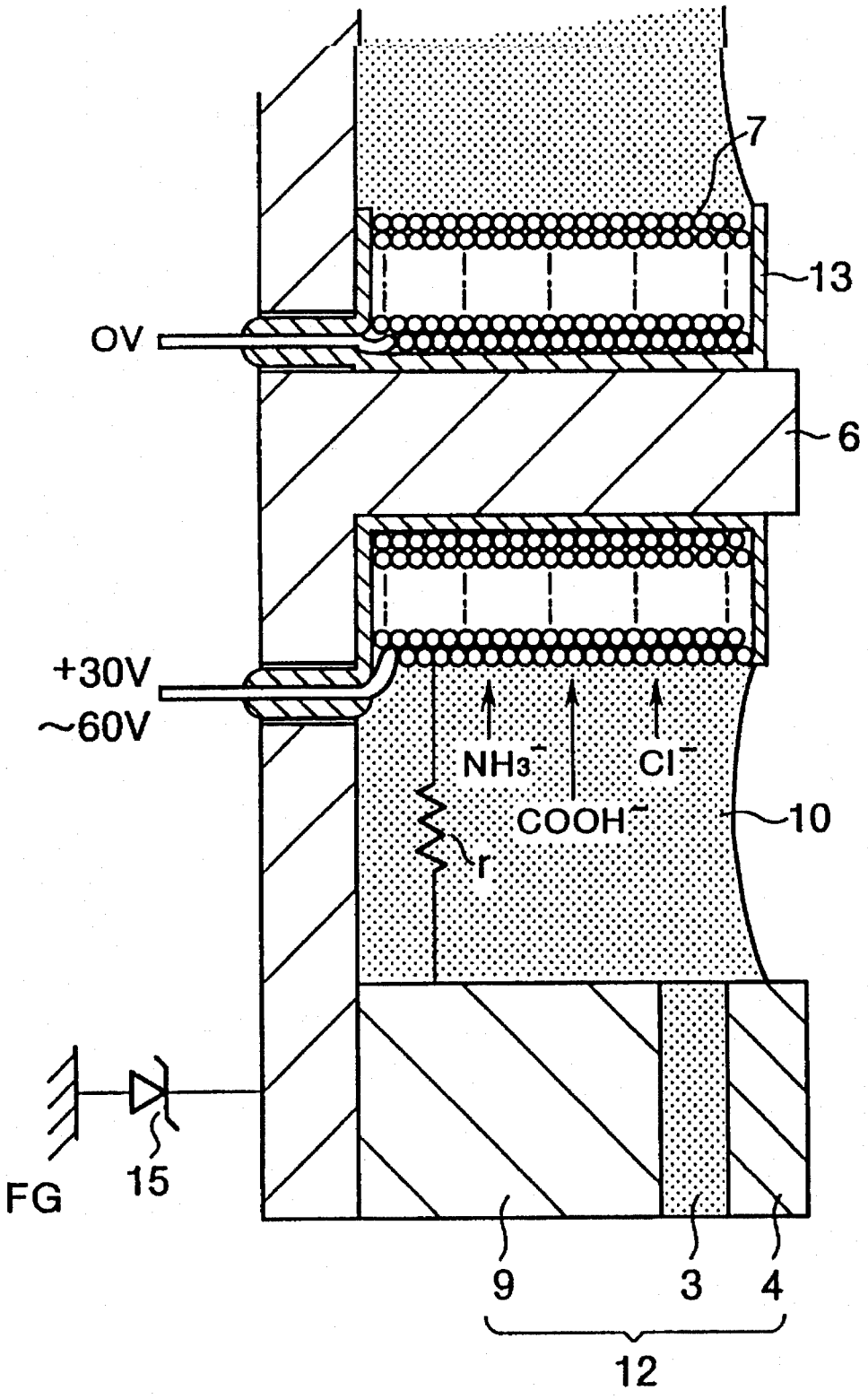
FIG. 4 shows a second embodiment of the invention.

FIG. 4 shows a second embodiment of the invention, in which the resistor 14 is replaced by a Zener diode 15. Other elements are the same as in the first embodiment, and are indicated by the same reference numerals.

The Zener diode 15 is preferably of a type in which reverse breakdown begins at a voltage (referred to as the Zener voltage) higher than the voltage applied to the print head (to the demagnetizing coil 7) during printing. The preferred Zener voltage is about one hundred volts. When a reverse voltage less than the Zener voltage is applied to the Zener diode 15, i.e. when the potential difference between the head frame 12 and frame ground FG is less than the Zener voltage, the Zener diode 15 should limit reverse current flow to one microampere or less. Accordingly, when the potential drop from head frame 12 to frame ground FG is several tells of volts, the Zener diode 15 will offer an electrical resistance of at least several tens of megohms. If the potential difference between the head frame 12 and frame ground FG exceeds the Zener voltage, however, avalanche breakdown occurs and the electrical resistance of the Zener diode 15 quickly becomes negligible.

If the print head is driven at a voltage well below the Zener voltage, such as at thirty to sixty volts, the series resistance between the demagnetizing coil 7 and frame ground will be at least several tells of megohms, providing excellent protection against electrocorrosion.

When static charge accumulates on the print head, however, the potential difference between the print head and frame ground normally reaches a value of several kilovolts, which is far above the Zener voltage. Discharge of static charge from the print head to frame ground is therefore substantially unimpeded by the Zener diode 15.

Insertion of the Zener diode 15 in FIG. 4 thus provides an impact printer in which both electrocorrosion and electrostatic discharge damage to the print head are effectively prevented.

The invention is not restricted to the voltages and resistance values mentioned in the preceding embodiments, or to the specific print-head structure shown in the drawings. Those skilled in the art will recognize that various modifications are possible without departing from the scope claimed below.

What is claimed is:

1. An impact printer, comprising:

a print head having:

a head frame including a permanent magnet for generating magnetic flux;

a demagnetizing coil for having a coil voltage selectively applied thereto to generate counter-magnetic flux for canceling out the magnetic flux from the permanent magnet, the demagnetizing coil generating heat during operation thereof; and a filling compound disposed between the demagnetizing coil and the head frame, the filling compound mechanically supporting the demagnetizing coil and dissipating the heat generated by the demagnetizing coil, the filling compound presenting a resistance between the head frame and the demagnetizing coil, the coil voltage causing a leakage current from the demagnetizing coil across the filling compound to the head frame, the leakage current comprising a flow of filling compound ions;

a printer chassis acting as an electrical frame ground; and a Zener diode coupled in series between the head frame and the chassis, the Zener diode operating in breakdown and non-breakdown modes defined by a reverse breakdown voltage higher than the coil voltage such that the Zener diode normally operates in the non-breakdown mode, the Zener diode permitting a non-breakdown reverse current to flow when in the non-breakdown mode, the non-breakdown reverse current having a maximum value not exceeding one microampere, the maximum value of the non-breakdown reverse current limiting the leakage current from the demagnetizing coil across the filling compound to the head frame, wherein the leakage current is reduced as compared with the leakage current when the head frame is grounded to the chassis.

2. The printer of claim 1, wherein the filling compound is an epoxy resin.

3. The printer of claim 1, wherein the reverse breakdown voltage is at least one hundred volts.

* * * * *